US009611668B2

(12) United States Patent
Van Der Meijden et al.

(10) Patent No.: US 9,611,668 B2
(45) Date of Patent: Apr. 4, 2017

(54) AUTOMATIC POOL CLEANERS AND COMPONENTS THEREOF

(75) Inventors: Hendrikus Johannes Van Der Meijden, Midrand (ZA); Michael Edward Moore, Johannesburg (ZA); Bruce David Harbottle, Johannesburg (ZA); David Andrew Klimas, Ramona, CA (US); Mark J. Bauckman, San Marcos, CA (US)

(73) Assignee: ZODIAC POOL SYSTEMS, INC., Vista, CA (US)

( * ) Notice: Subject to any disclaimer, the term of this patent is extended or adjusted under 35 U.S.C. 154(b) by 576 days.

(21) Appl. No.: 13/159,499

(22) Filed: Jun. 14, 2011

(65) Prior Publication Data

US 2011/0314617 A1 Dec. 29, 2011

Related U.S. Application Data

(60) Provisional application No. 61/398,592, filed on Jun. 28, 2010.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/1636; B63B 59/06; B63B 59/10
USPC ..... 15/1.7
See application file for complete search history.

(56) References Cited

U.S. PATENT DOCUMENTS

| | | | | | |
|---|---|---|---|---|---|
| 2,311,393 | A | * | 2/1943 | Honeywell | 180/6.66 |
| 2,419,369 | A | * | 4/1947 | Ritzert | 400/54 |
| 2,876,479 | A | * | 3/1959 | Kaufman | 15/323 |
| 3,439,368 | A | | 4/1969 | Myers | |
| 3,676,884 | A | * | 7/1972 | Wulc | 15/1.7 |
| 3,892,282 | A | | 7/1975 | Wulc | |
| 4,052,950 | A | * | 10/1977 | Hirata | 114/222 |
| 4,100,641 | A | * | 7/1978 | Pansini | 15/1.7 |
| 4,154,680 | A | | 5/1979 | Sommer | |
| 4,262,972 | A | * | 4/1981 | Falk | 305/163 |
| 4,449,265 | A | | 5/1984 | Hoy | |
| 4,558,479 | A | * | 12/1985 | Greskovics et al. | 15/1.7 |
| 4,682,558 | A | * | 7/1987 | Broersz | 114/222 |

(Continued)

FOREIGN PATENT DOCUMENTS

| | | |
|---|---|---|
| EP | 0657603 A1 | 6/1995 |
| EP | 2163711 A2 | 3/2010 |

(Continued)

OTHER PUBLICATIONS

International Search Report and Written Opinion dated Nov. 7, 2011 in Application No. PCT/IB2011/001333.

(Continued)

*Primary Examiner* — Joseph J Hail
*Assistant Examiner* — Joel Crandall
(74) *Attorney, Agent, or Firm* — Kilpatrick Townsend & Stockton LLP; Dean W. Russell

(57) ABSTRACT

Automatic pool cleaners (APCs) and components thereof are detailed. The APCs may include tracks for movement, with the tracks having teethed internal surfaces. The APCs additionally may supply shift mechanisms for purposes of changing direction of their movement and incorporate bladed scrubbers and easily-opening bodies.

14 Claims, 12 Drawing Sheets

(56) References Cited

U.S. PATENT DOCUMENTS

| | | | | | |
|---|---|---|---|---|---|
| 4,697,536 | A * | 10/1987 | Hirata | 114/222 | |
| 4,835,809 | A | 6/1989 | Roumagnac | | |
| 5,001,800 | A * | 3/1991 | Parenti et al. | 15/1.7 | |
| 5,028,321 | A | 7/1991 | Stone et al. | | |
| 5,174,222 | A * | 12/1992 | Rogers | 114/222 | |
| 5,197,158 | A | 3/1993 | Moini | | |
| 5,435,031 | A * | 7/1995 | Minami et al. | 15/1.7 | |
| 5,569,371 | A * | 10/1996 | Perling | 210/85 | |
| 5,617,600 | A * | 4/1997 | Frattini | 15/1.7 | |
| 5,720,068 | A | 2/1998 | Clark et al. | | |
| 5,730,553 | A * | 3/1998 | Miura et al. | 405/191 | |
| 5,930,856 | A * | 8/1999 | Van Der Meyden et al. | 15/1.7 | |
| 5,947,051 | A * | 9/1999 | Geiger | 114/313 | |
| 6,070,547 | A * | 6/2000 | Achord | B63B 59/10 | 114/222 |
| 6,094,764 | A * | 8/2000 | Veloskey et al. | 15/1.7 | |
| 6,292,970 | B1 | 9/2001 | Rief et al. | | |
| 6,619,922 | B2 | 9/2003 | Illingworth et al. | | |
| 6,665,900 | B2 * | 12/2003 | Wichmann et al. | 15/1.7 | |
| 6,742,613 | B2 * | 6/2004 | Erlich et al. | 180/21 | |
| 6,811,687 | B2 * | 11/2004 | Illingworth | 210/167.1 | |
| 6,854,148 | B1 * | 2/2005 | Rief et al. | 15/1.7 | |
| 7,162,763 | B2 * | 1/2007 | Henkin et al. | 15/1.7 | |
| 7,464,429 | B2 * | 12/2008 | Stoltz | 15/1.7 | |
| 7,661,381 | B2 * | 2/2010 | Gorelik et al. | 114/222 | |
| 7,690,066 | B2 * | 4/2010 | Stoltz et al. | 15/1.7 | |
| 8,225,446 | B2 * | 7/2012 | Hui | 15/1.7 | |
| 8,341,789 | B2 * | 1/2013 | Garti | 15/1.7 | |
| 8,393,031 | B2 * | 3/2013 | Pichon et al. | 15/1.7 | |
| 8,397,331 | B2 * | 3/2013 | Pichon et al. | 15/1.7 | |
| 2003/0132152 | A1 | 7/2003 | Illingworth | | |
| 2003/0182742 | A1 * | 10/2003 | Wichmann | E04H 4/1672 | 15/1.7 |
| 2004/0025269 | A1 * | 2/2004 | Pichon | 15/1.7 | |
| 2006/0282962 | A1 | 12/2006 | Henkin et al. | | |
| 2007/0028405 | A1 * | 2/2007 | Garti | 15/1.7 | |
| 2008/0125943 | A1 | 5/2008 | Finezilber | | |
| 2008/0307589 | A1 | 12/2008 | Schneider | | |
| 2009/0229061 | A1 | 9/2009 | Stoltz et al. | | |
| 2009/0307854 | A1 | 12/2009 | Garti | | |
| 2010/0065482 | A1 * | 3/2010 | Sumonthee | 210/167.1 | |
| 2010/0119358 | A1 | 5/2010 | van der Meijden et al. | | |
| 2010/0122422 | A1 | 5/2010 | Hui | | |
| 2010/0139995 | A1 * | 6/2010 | Rudakevych | B62D 55/06 | 180/9.32 |
| 2011/0088181 | A1 | 4/2011 | Rief et al. | | |
| 2011/0301752 | A1 * | 12/2011 | Finezilber | E04H 4/1654 | 700/245 |

FOREIGN PATENT DOCUMENTS

| | | | | |
|---|---|---|---|---|
| FR | 2929310 | A1 | 10/2009 | |
| GB | 2187940 | A * | 9/1987 | |
| JP | GB 2157158 | A * | 10/1985 | B63B 59/10 |
| WO | 2004055299 | A1 | 7/2004 | |
| WO | 2009095626 | A2 | 8/2009 | |

OTHER PUBLICATIONS

Annex to Form PCT/ISA/206 dated Dec. 6, 2011 in Application No. PCT/US2011/040250.
International Search Report and Written Opinion dated Dec. 6, 2001 in Application No. PCT/IB2011/001336.
International Search Report and Written Opinion dated Dec. 6, 2011 in Application No. PCT/US2011/040248.
International Search Report and Written Opinion dated Jan. 2, 2012 in Application No. PCT/IB2011/001334.
International Search Report and, Written Opinion dated Apr. 18, 2012 in Application No. PCT/US2011/040250.
International Preliminary Report on Patentability dated Jan. 10, 2013 in Application No. PCT/US2011/040250.
International Preliminary Report on Patentability dated Jan. 10, 2013 in Application No. PCT/US2011/040248.
International Preliminary Report on Patentability dated Jan. 10, 2013 in Application No. PCT/IB2011/001336.
International Preliminary Report on Patentability dated Jan. 10, 2013 in Application No. PCT/IB2011/001334.
International Preliminary Report on Patentability dated Jan. 10, 2013 in Application No. PCT/IB2011/001333.
Examination Report dated Jul. 28, 2014 issued in Australian Patent Application No. 2011279709.
Examination Report dated Jul. 23, 2014 issued in Australian Patent Application No. 2011273111.
Examination Report dated Aug. 13, 2014 issued in related Australian Patent Application No. 2011273113.
Examination Report dated Dec. 2, 2014 issued in Australian Patent Application No. 2011273112.
Examination Report dated Sep. 11, 2014 issued in Australian Patent Application No. 2011273112.
Examination Report No. 2 dated Feb. 10, 2015 issued in Australian Patent Application No. 2011273113, 3 pages.
Examination Report dated Nov. 27, 2014 issued in Australian Patent Application No. 2011273111, 3 pages.
Examination Report dated Jul. 18, 2014 issued in related Australian Patent Application No. 2011279710.
Australian Patent Application No. 2011273113 , Examination Report on Voluntary Amendments, mailed Mar. 2, 2016, 2 pages.

* cited by examiner

AUTOMATIC POOL CLEANERS AND COMPONENTS THEREOF

CROSS-REFERENCE TO RELATED APPLICATION

This application claims the benefit of U.S. Provisional Application No. 61/398,592 filed on Jun. 28, 2010, the contents of which are incorporated herein by reference.

FIELD OF THE INVENTION

This invention relates to automatic cleaners for liquid-containing bodies and more particularly, although not necessarily exclusively, to tracked cleaners for pools and spas.

BACKGROUND OF THE INVENTION

U.S. Pat. No. 4,449,265 to Hoy illustrates an example of a wheeled automatic swimming pool cleaner. Powering the wheels is an impeller comprising an impeller member and pairs of vanes. Evacuating the impeller causes water within a swimming pool to interact with the vanes, rotating the impeller member. The impeller is reversible, with the impeller member apparently moving laterally when the pool cleaner reaches an edge of a pool to effect the rotation reversal.

U.S. Pat. No. 6,292,970 to Rief, et al., describes a turbine-driven automatic pool cleaner ("APC"). The cleaner includes a turbine housing defining a water-flow chamber in which a rotor is positioned. Also included are a series of vanes pivotally connected to the rotor. Water interacting with the vanes rotates the rotor in one direction (clockwise as illustrated in the Rief patent), with the vanes pivoting when encountering "debris of substantial size" to allow the debris to pass through the housing for collection.

U.S. Patent Application Publication No. 2010/0119358 of Van Der Meijden, et al. discloses fluid-powered devices that may, for example, function as motors for APCs. Versions of the devices include paired paddles, with each paddle of a pair connected to the other paddle of a pair via a shaft. When a first paddle of a pair in a particular manner relative to flowing fluid, the other paddle of the pair is oriented approximately normal to the first paddle.

SUMMARY OF THE INVENTION

The present invention provides innovative developments in the field of APCs. In particular, for APCs having tracks as part of their motive assemblies, the tracks may be formed so that their internal surfaces include teeth. The teeth may engage shift mechanisms for purposes of changing direction of movement of the cleaners.

Additionally, a shift mechanism may include a cam designed to push a shifter in either of two directions so as to engage a different one of two (mitre) drive gears. Direction of travel of the APC depends on which drive gear is engaged. Beneficially, engaging one drive gear produces forward motion, whereas engaging the other drive gear produces rearward, or reverse, motion.

Moreover, left and right sides of the APC differ for driving purposes. In some versions of the invention, different numbers of cams and teeth appear at one side of the cleaner as compared to the other side. Consequently, motion of the APC will not be constant, but instead will vary as a function of time.

Lower portions of APCs of the present invention may include one or more bladed "fans" or "scrubbers." Preferably, the blades are at least somewhat flexible; as such, they may accommodate larger items of debris being evacuated from the pool into the cleaner body. Positioning the scrubbers on either side of the debris inlet to the body also provides a wider cleaning path for the APC and produces vortexes actively inducing debris-laded water to flow toward the inlet. The scrubbers additionally produce downward force in operation, helping offset buoyancy forces and assisting the APC in remaining in contact with a to-be-cleaned surface.

Cleaners of the present invention also may include easily-opening bodies. Certain versions incorporate a hood, or top, that may be moved to access internal body components; a presently-preferred version has a hinged top that may pivot to permit such access. Among other things, an easily-opening body facilitates removal of debris retained within the body.

It thus is an optional, non-exclusive object of the present invention to provide improved APCs.

It is another optional, non-exclusive object of the present invention to provide reconfigured tracks for track-driven APCs.

It is also an optional, non-exclusive object of the present invention to provide tracks having teeth on their internal surfaces.

It is a further optional, non-exclusive object of the present invention to provide shift mechanisms for non-robotic APCs.

It is, moreover, an optional, non-exclusive object of the present invention to provide shift mechanisms in which cams cause shifters to engage differing drive gears.

It is an additional optional, non-exclusive object of the present invention to provide bladed scrubbers producing downward force in opposition to upward buoyancy forces.

It is yet another optional, non-exclusive object of the present invention to provide APCs with easily-opening bodies.

Other objects, features, and advantages of the present invention will be apparent to those skilled in relevant fields with reference to the remaining text and the drawings of this application.

DETAILED DESCRIPTION

Figure 1:
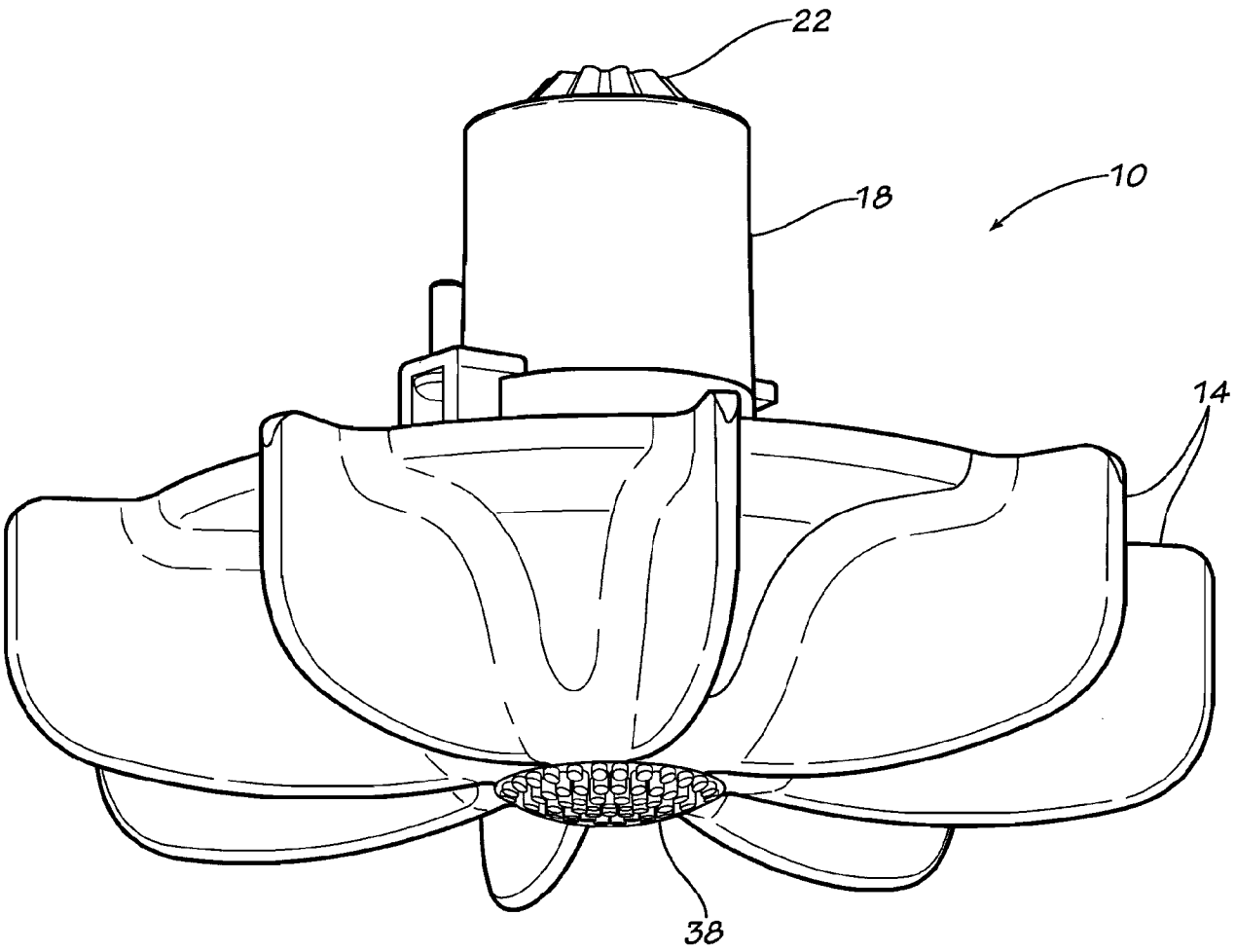
FIG. 1 is a perspective, generally side view of an exemplary scrubber of an APC of the present invention.
Figure 8:
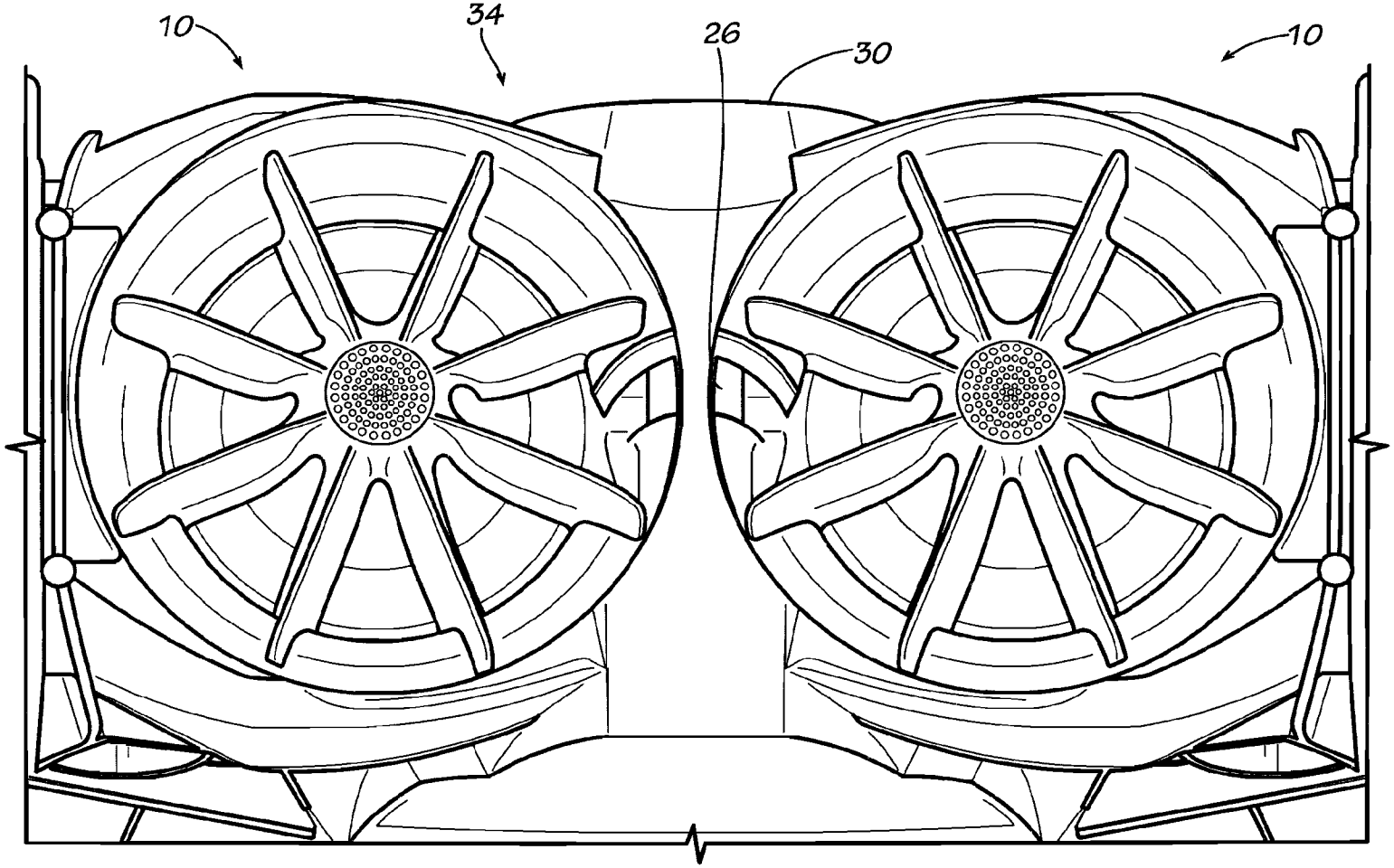
FIG. 8 is a perspective, generally bottom view of scrubbers (such as that of FIG. 1) of an APC of the present invention.
Figure 9:
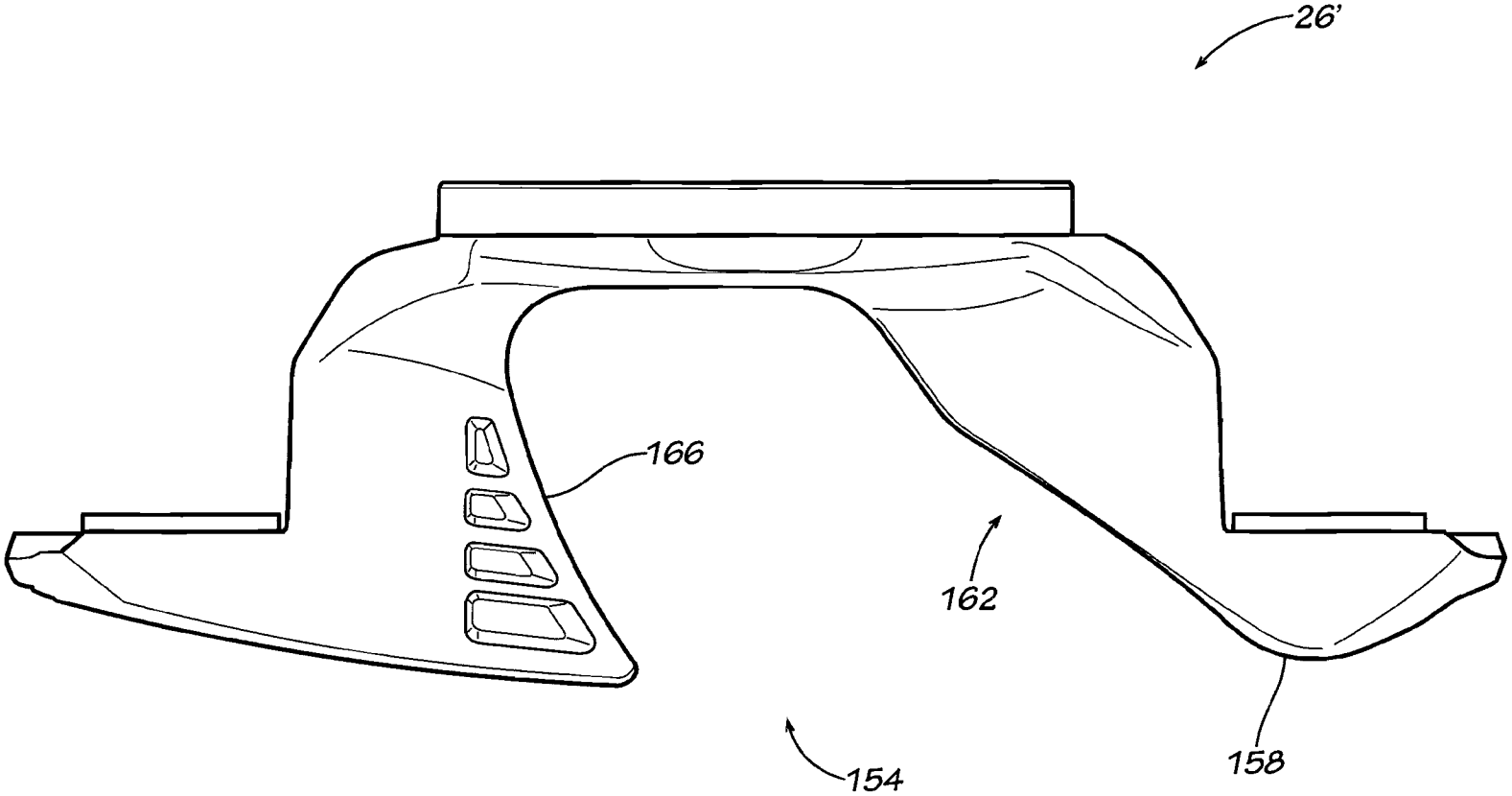
FIGS. 9-11 are various views of an alternate inlet of an APC of the present invention.
Figure 10:
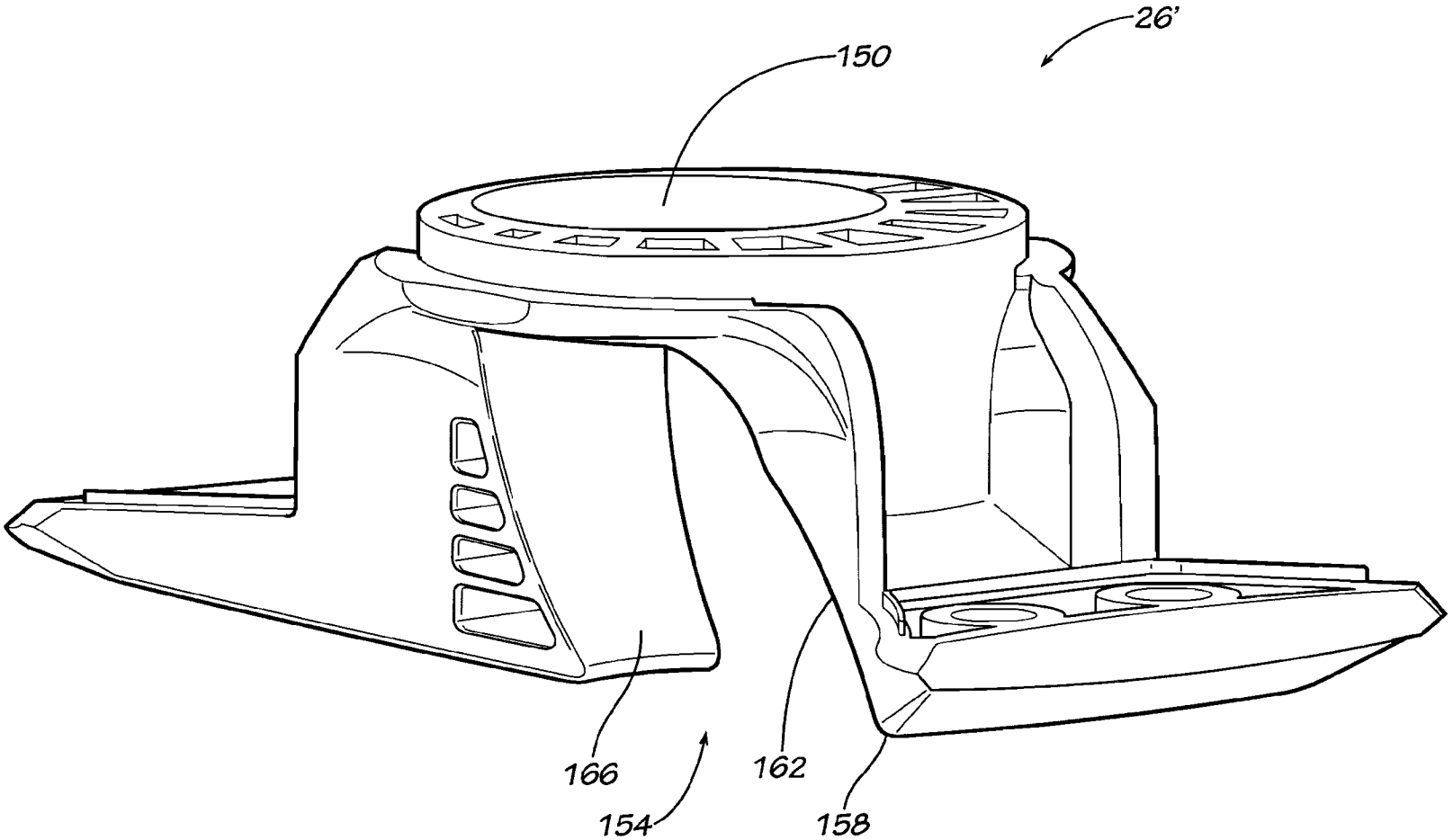
Figure 11:
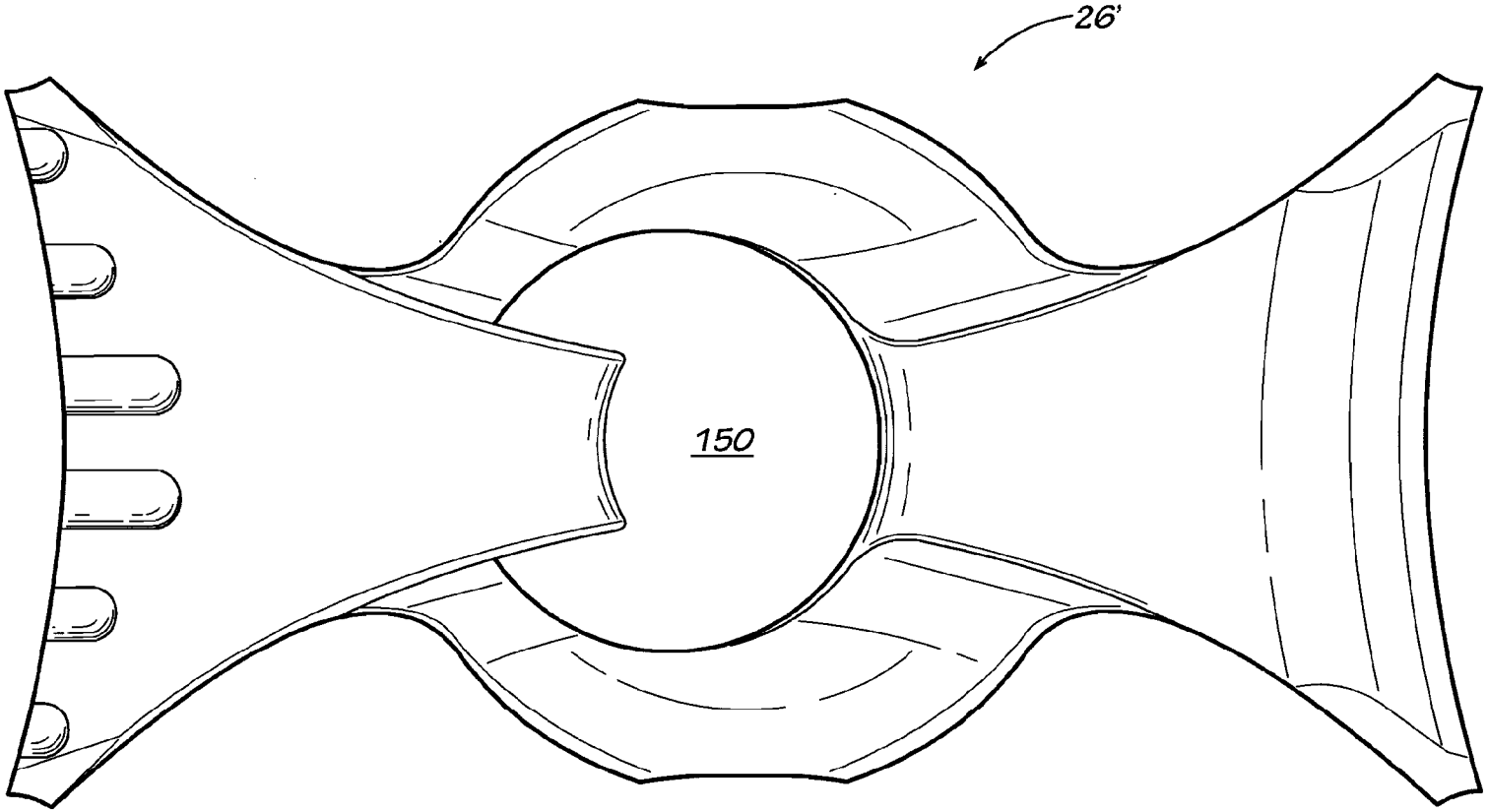

Illustrated in FIGS. 1 and 8 is exemplary scrubber 10 of the present invention. Scrubber 10 may include blades 14, shaft 18 and, optionally, mitre or other gear 22. In use, scrubber 10 desirably rotates about shaft 18 so as to move water or other liquid toward inlet 26 of body 30 of automatic pool cleaner 34. Such rotation may be caused by interaction of gear 22 with a corresponding gear or other device typically located within body 30.

Blades 14 preferably are "semi-rigid" in nature. As used herein, "semi-rigid" means that blades 14 have sufficient flexibility to accommodate passage into inlet 26, without blockage, of at least some larger types of debris often found in outdoor swimming pools. The term also means that blades 14 nevertheless have sufficient rigidity to move volumes of water toward inlet 26 as they rotate about shaft 18. A presently-preferred material from which blades 14 may be made is molded thermoplastic polyurethane, although other materials may be used instead.

FIGS. 1 and 8 depict the presence of eight blades 14 extending radially from shaft 18 and equally spaced about the circumference of the shaft 18. Fewer or greater numbers of blades 14 may be employed as appropriate, however. Scrubber 10 additionally optionally may include wear surface 38 that may, at times, contact the surface to be cleaned.

Shown in FIG. 8 are two scrubbers 10 positioned opposite inlet 26. In some versions of the invention, blades 14 of one scrubber 10 rotate clockwise about corresponding shaft 18, while blades 14 of the other scrubber 10 rotate counterclockwise. Resulting is vortex action tending to induce debris-laden water toward inlet 26. Such rotation also produces downforce biasing cleaner 34 toward a pool floor or other surface to be cleaned. In other versions, blades 14 of the one scrubber 10 rotate counterclockwise, with blades 14 of the other scrubber 10 rotating clockwise. In yet other versions of the invention, only one scrubber 10 may be utilized as part of cleaner 34.

Figure 2:
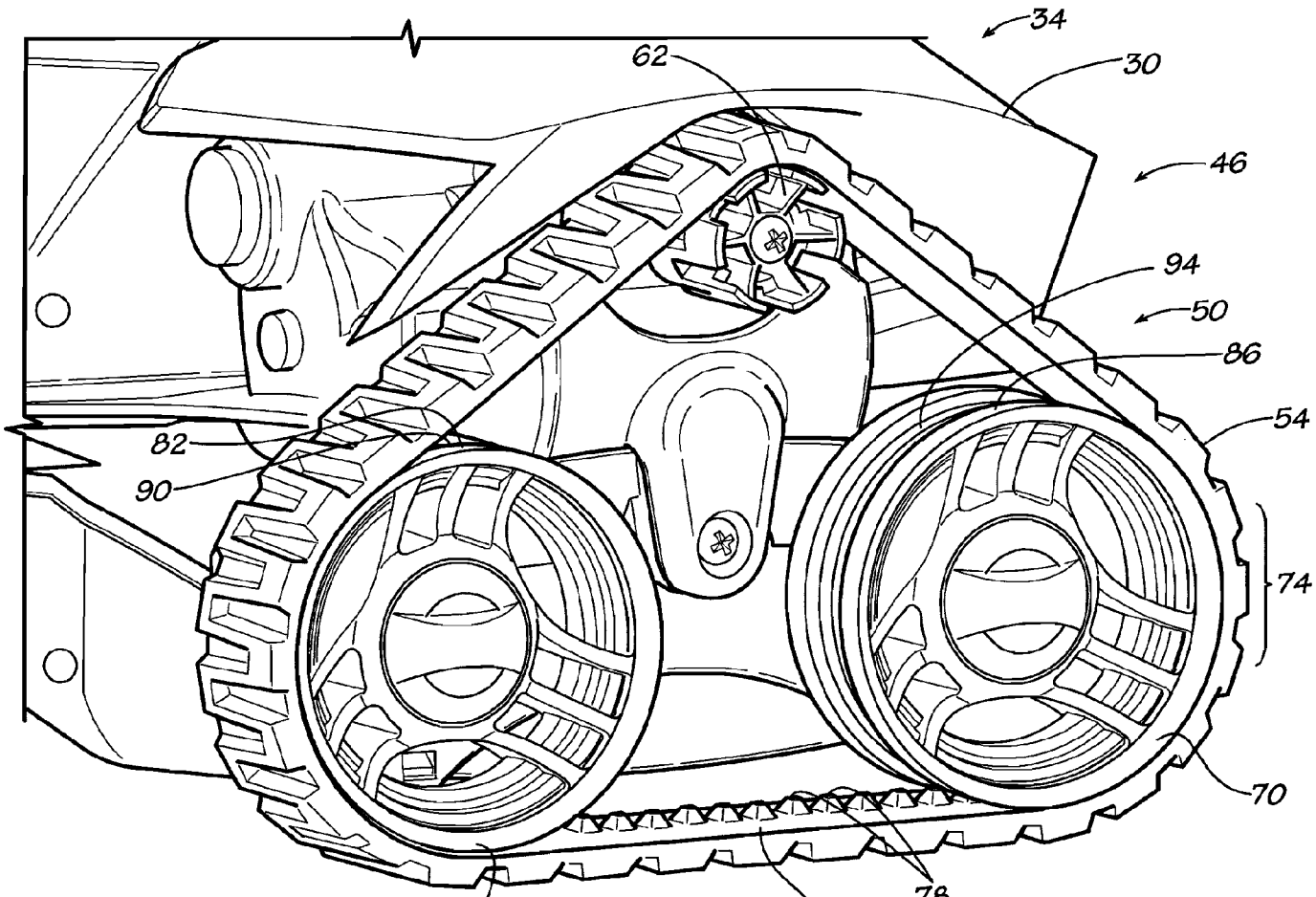
FIG. 2 is a perspective, generally side view of an exemplary motive assembly of an APC of the present invention.

FIG. 2 depicts aspects of motive assembly 46 of the present invention. Assembly 46 may include (closed-loop) track 50 having external and internal surfaces 54 and 58, respectively. It also may include pulley or drive wheel 62 and undriven wheels 66 and 70. An assembly 46 will be present at each of the left and right sides of cleaner 34.

External surface 54 of track 50 may contain treads 74 in any configuration suitable for facilitating movement of cleaner 34. Of note, moreover, internal surface 58 of track 50 may include teeth 78, which may be or comprise projections or protrusions of any suitable shape or size. As shown in FIG. 2, teeth 78 may be spaced longitudinally along internal surface 58 and generally laterally centrally located. In use, internal surface 58 bears against respective circumferential surfaces 82 and 86 of undriven wheels 66 and 70. To accommodate the presence of teeth 78, wheels 66 and 70 may have laterally centrally-located circumferential grooves 90 and 94 in which teeth 78 are freely received.

By contrast, teeth 78 are designed to engage drive wheel 62. Accordingly, clockwise rotation of drive wheel 62 (as shown in FIG. 2) will move track 50 so that cleaner 34 moves to the left of the drawing of FIG. 2. Counterclockwise rotation of drive wheel 62 will move track 50 so that cleaner 34 moves to the left of the drawing of FIG. 2. Thus, both forward and rearward motion of cleaner 34 may be achieved.

Figure 3:
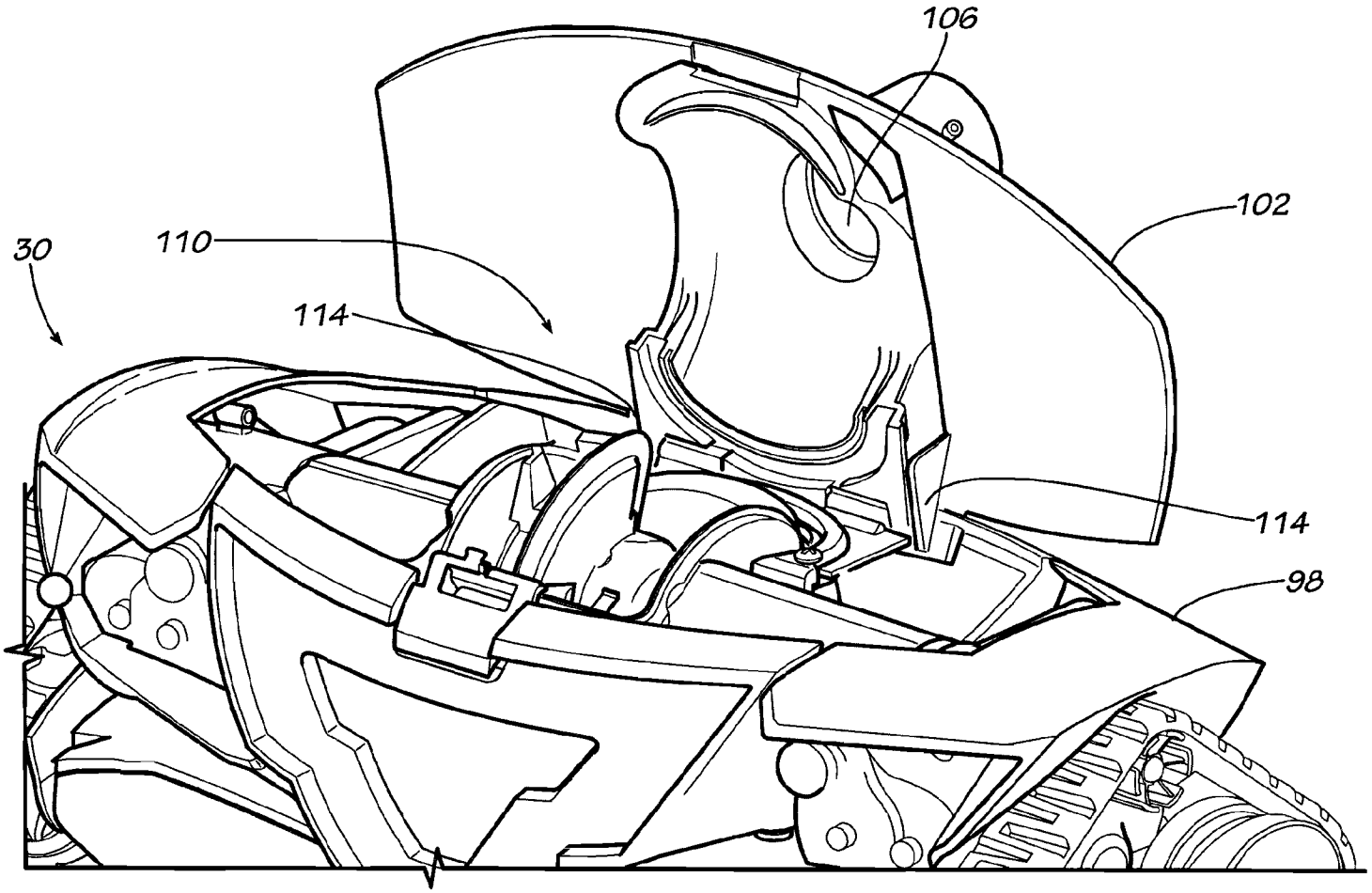
FIG. 3 is a perspective, generally top view of portions of an exemplary body of an APC of the present invention.

Illustrated in FIG. 3 are portions of exemplary body 30 of the present invention. Body may comprise lower section 98 and upper section 102. In the version of cleaner 34 depicted in FIG. 3, upper section 102 may contain outlet 106 through which water may exit the cleaner 34. Upper section 102 additionally may include a swivel about outlet 106 for attachment of a hose.

Upper section 102 further preferably is moveable relative to lower section 98 so as to expose interior 110 of body 30. So exposing interior 110 facilitates both access to components of cleaner 34 within body 30 (including, if desired, a fluid-powered motor of the type disclosed in the Van Der Meijden application) and inspection and removal of any damaged centrally-located parts. It also may facilitate removal of debris lodged in interior 110. As shown in FIG. 3, upper section 102 may be connected to lower section 98 using hinges 114; accordingly, it may pivot relative to lower section 98. Other means of exposing interior 110 of body 30 may be employed instead, however, as appropriate or desired.

Additional aspects of motive assembly 46 are illustrated in FIGS. 4-7. Opposite shaft 116 from drive wheel 62 is first gear 118. Oriented generally perpendicular to shaft 116 is shaft 122 on which second gear 126 and third gear 130 are located. Second and third gears 126 and 130 are fixed to shaft 122 so that they rotate together as the shaft 122 rotates, with rotation of shaft 122 caused by a hydraulic motor or other propulsion source.

First gear 118 is intended alternately to engage second gear 126 and third gear 130. By engaging a rotating second gear 126, for example, first gear 118 will be caused to rotate in a particular direction (e.g. counterclockwise), in turn rotating shaft 116 in the same direction. By contrast, if first gear 118 engages a rotating third gear 130, first gear 118 and shaft 116 will be caused to rotate in the opposite direction (i.e. clockwise). Because it is fixed to shaft 116, drive wheel 62 rotates as does the shaft 116. Thus, merely by changing the engagement of first gear 118, cleaner 34 may be caused to change its direction of travel from forward to reverse (or vice-versa).

Figure 4:
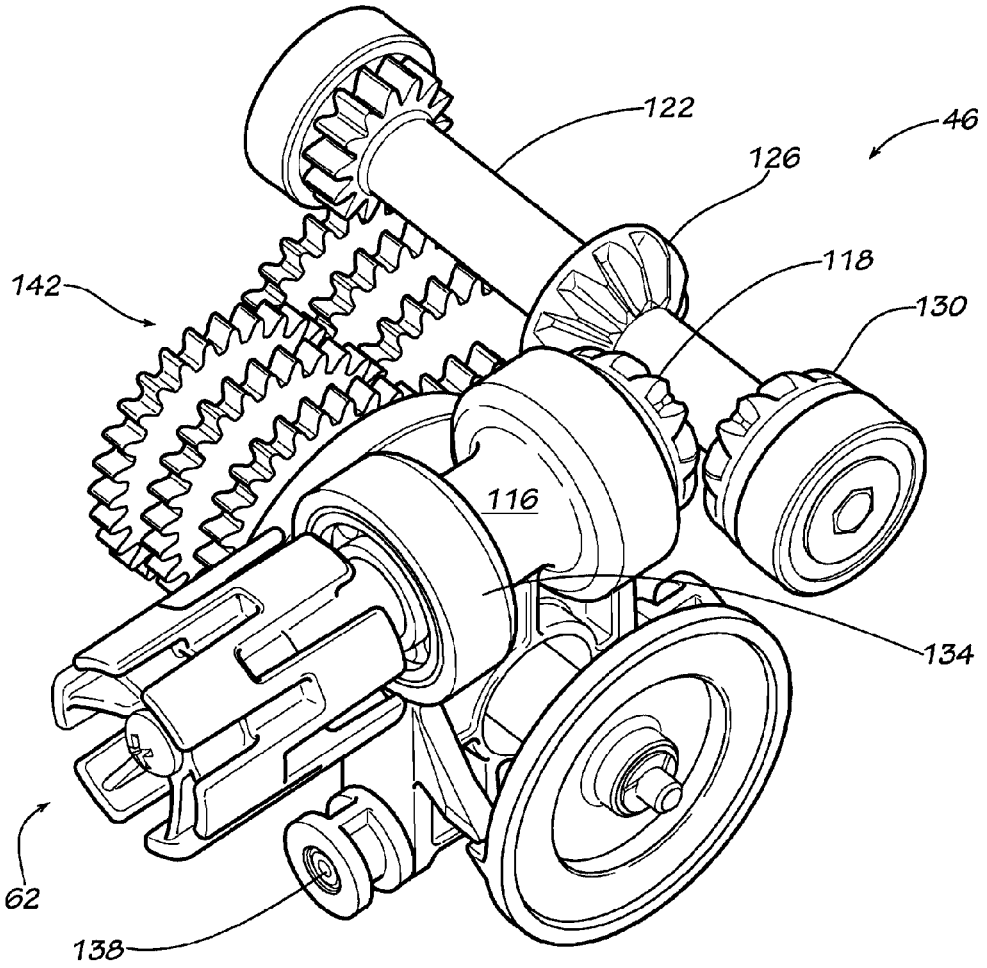
FIGS. 4-7 are perspective views of a shifting drive mechanism of an APC of the present invention.
Figure 5:
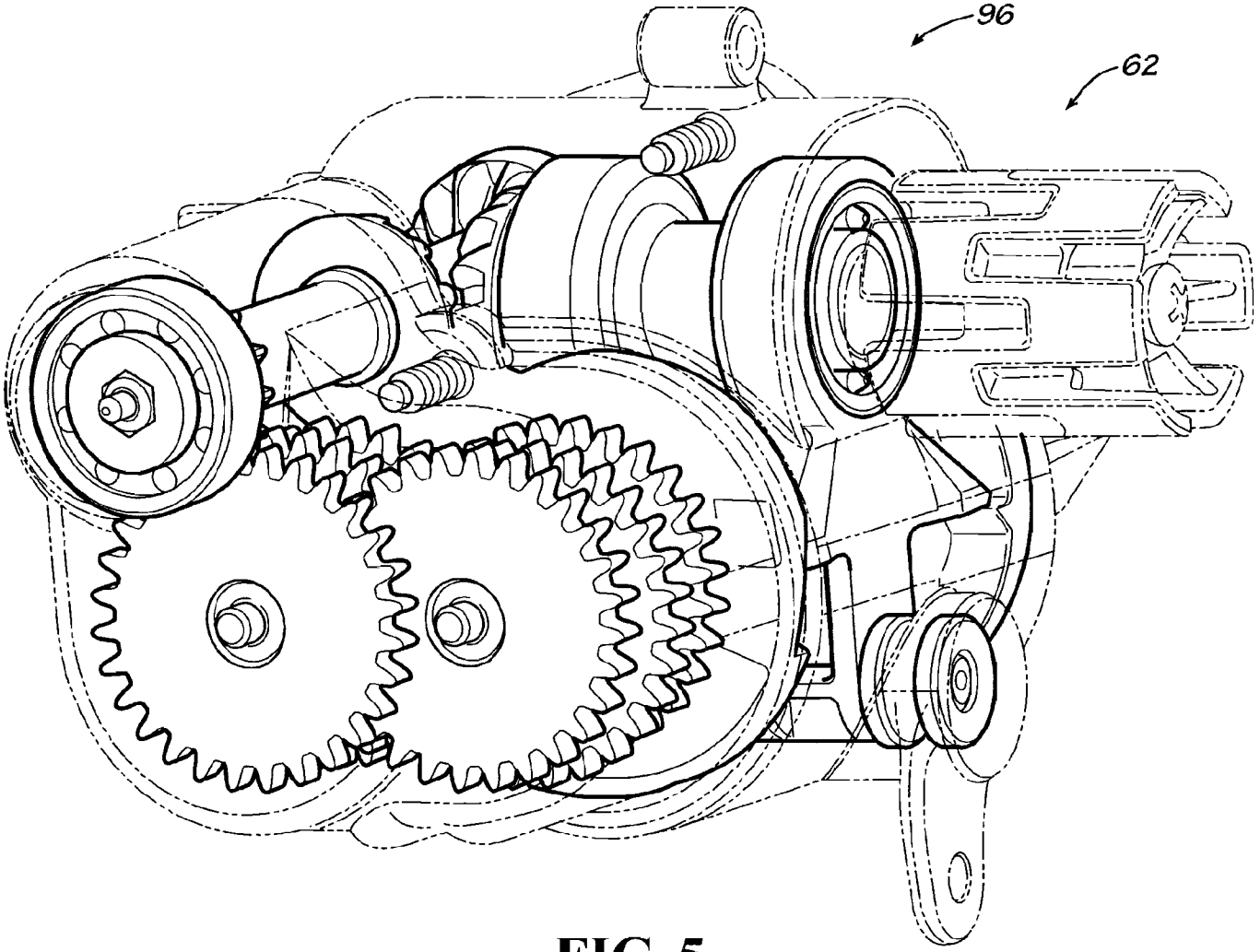
Figure 6:
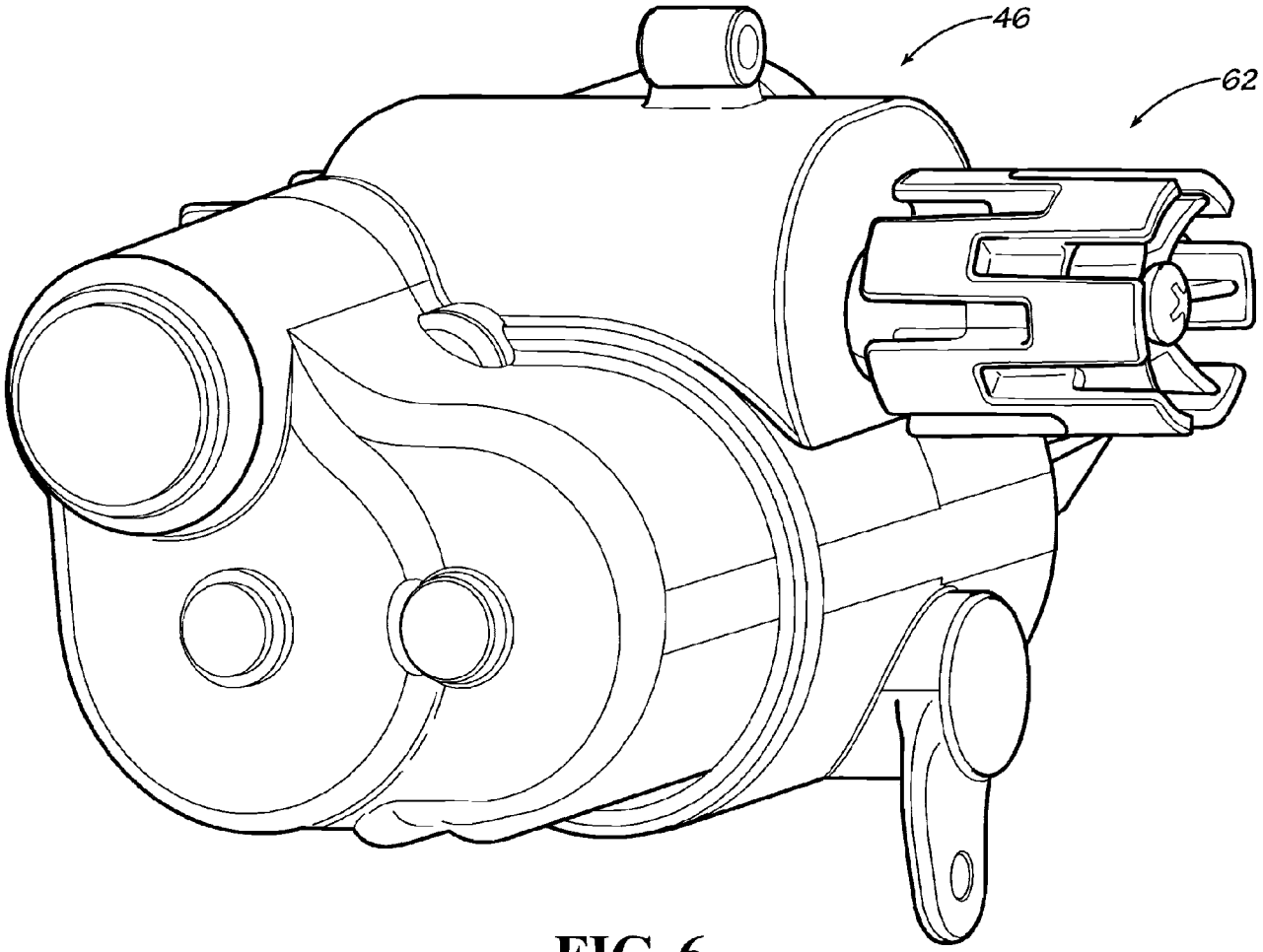
Figure 7:
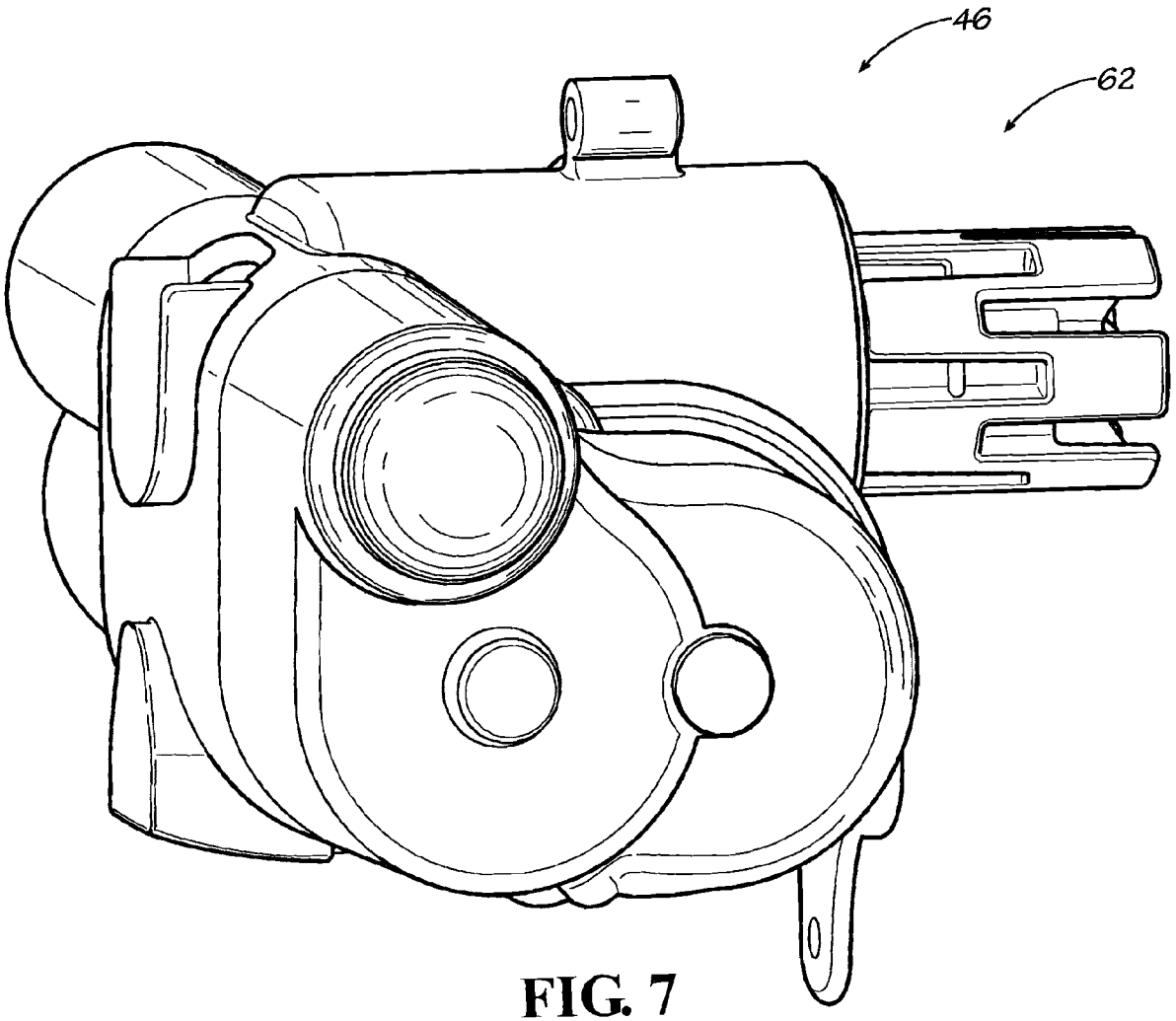

In FIG. 4, first gear 118 is shown as not engaging either second gear 126 or third gear 130—in essence in a neutral position in which drive wheel 62 is not rotating. However, boss 134, which surrounds shaft 116, may pivot about shaft 138 so as to translate shaft 116 to its left or right, in turn causing first gear 118 to engage either second gear 126 or third gear 130. If boss 134 pivots to the left of FIG. 4, first gear 118 engages second gear 126. Pivoting of boss 134 to the right of FIG. 4 causes first gear 118 to engage third gear 130.

A cam and gearing assembly 142 may be used to cause boss 134 to pivot either left or right about shaft 138. Moreover, because two motive assemblies 46 preferably are used for a cleaner 34 (one on each side of body 30, as mentioned earlier), their cam and gearing assemblies 142 may differ somewhat. Consequently, motion (direction, speed, or both) of one drive wheel 62 may differ at times from motion of the other drive wheel, causing cleaner 34 to move in non-linear manner.

Figure 12:
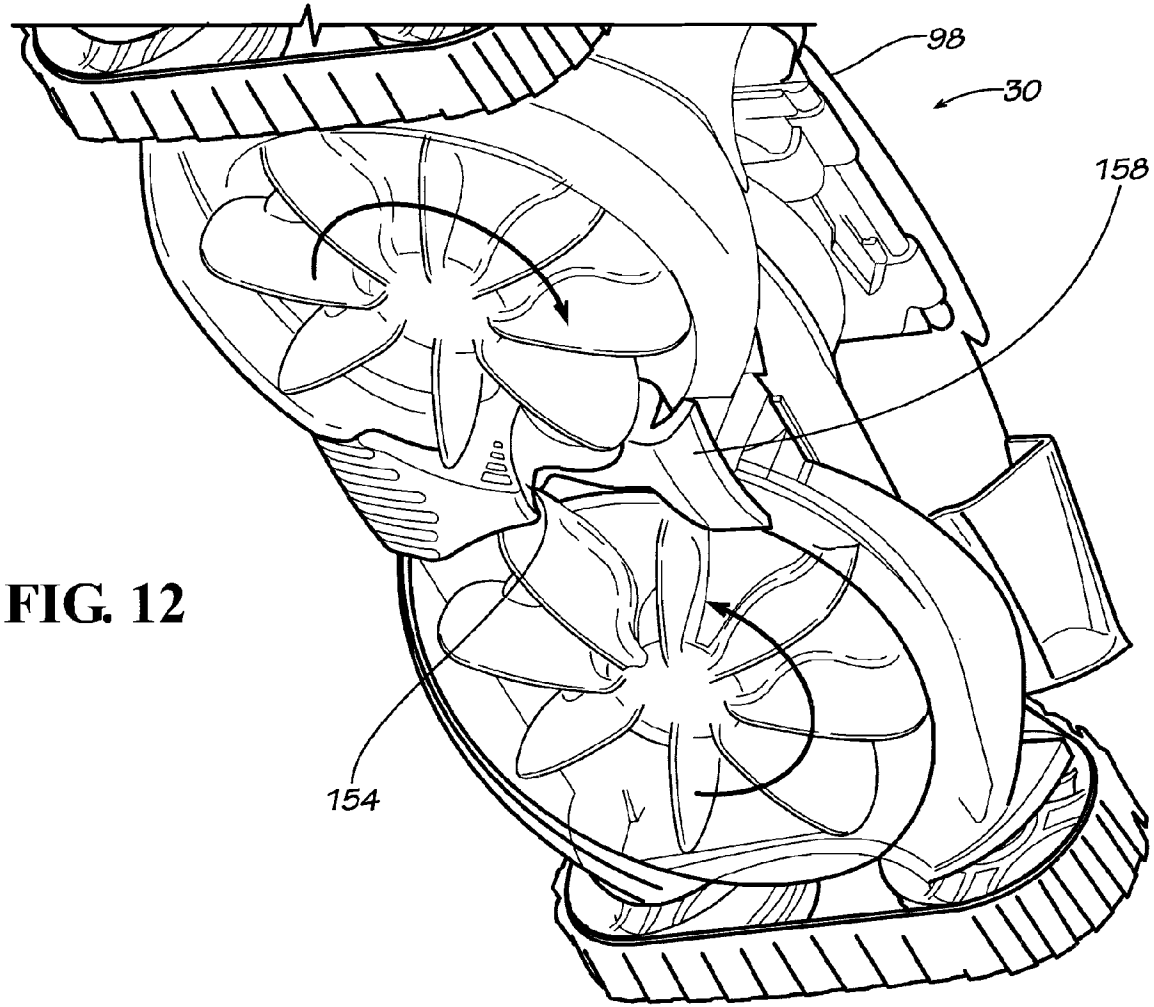
FIG. 12 is a perspective, generally bottom view of an APC of the present invention showing scrubbers and the inlet of FIGS. 9-11.

FIGS. 9-12 illustrate alternate inlet 26' of the present invention. Inlet 26' is either formed as part of lower section 98 of body 30 or attached to the lower section 98 (as shown in FIG. 12) intermediate scrubbers 10. Included as part of inlet 26' may be both fluid opening 150 and scoop 154, the latter configured to improve pick-up of debris. In particular, scoop 154 may comprise a rounded protrusion or bump 158 and an elongated, curved wall 162 (the continuation of which, denoted element 166, may also be curved if desired). Bump 158 increases velocity of debris-laden water being pushed by scrubbers 10 toward opening 150, while wall 162 effectively conveys ("scoops") that water to the opening 150.

The foregoing is provided for purposes of illustrating, explaining, and describing embodiments of the present invention. Modifications and adaptations to these embodiments will be apparent to those skilled in the art and may be made without departing from the scope or spirit of the invention. As one of many examples of possible modifications, one or more cam and gearing assemblies 142 may be adjustable or programmable by a user of cleaner 34. The contents of the Hoy and Rief patents and of the Van Der Meijden application are incorporated herein in their entireties by this reference.

We claim:

1. An automatic swimming pool cleaner comprising:

a. a body configured for travel along a surface to be cleaned and defining an inlet for receiving pool water; and b. first means, (i) configured for rotation about an axis generally perpendicular to the surface to be cleaned, (ii) positioned in use closer than the inlet to the surface to be cleaned, (iii) creating during operation a region between the body and the surface to be cleaned that has lower pressure than the ambient water pressure near the surface to be cleaned, and (iv) comprising a shaft laterally offset from the inlet and blades extending radially from the shaft, for pushing pool water laterally toward the inlet.

2. An automatic swimming pool cleaner according to claim 1, further comprising second means, configured for rotation about an axis generally perpendicular to the surface to be cleaned, for pushing pool water toward the inlet.

3. An automatic swimming pool cleaner according to claim 2 in which the first means and the second means are positioned on opposite sides of the inlet.

4. An automatic swimming pool cleaner according to claim 2 in which the first means is configured to rotate in a first direction and the second means is configured to rotate in a second direction opposite the first direction.

5. An automatic swimming pool cleaner according to claim 4 in which the second means comprises blades.

6. An automatic swimming pool cleaner according to claim 1 in which the first means comprises a wear surface configured to contact the surface to be cleaned.

7. An automatic swimming pool cleaner according to claim 1 in which the first means is at least partly recessed within the body.

8. An automatic swimming pool cleaner comprising:

a. a body comprising (i) a water inlet for receiving debris-laden water of a swimming pool, (ii) a water outlet, and (iii) a fluid-powered motor through which the debris-laden water passes;

b. at least one driven wheel or pulley;

c. at least one undriven wheel having a circumferential groove having a width; and d. a continuous, one-piece, closed-loop track (i) configured to contact the at least one driven wheel or pulley and the at least one undriven wheel, (ii) having a width greater than the width of the circumferential groove, and (iii) having an external surface and an internal surface, the internal surface including at least one tooth received by the circumferential groove.

9. An automatic swimming pool cleaner according to claim 8 in which the undriven wheel has a width and the circumferential groove is positioned centrally along the width.

10. An automatic swimming pool cleaner according to claim 8 in which the internal surface includes a plurality of teeth, with adjacent teeth of the plurality of teeth being spaced longitudinally along the internal surface and not extending the width of the continuous, one-piece, closed-loop track.

11. An automatic swimming pool cleaner comprising a body having an interior and comprising:

a. a lower section defining an inlet for receiving pool water;

b, a fluid-powered motor positioned at least partly in the lower section in a flow path of debris-laden water received by the inlet;

c. an upper section defining a water outlet and comprising means for connecting the body to a hose; and d. at least one hinge connecting the upper section to the lower section so that the upper section is moveable relative to the lower section to expose a downstream portion of the fluid-powered motor for removal of debris lodged therein.

12. An automatic swimming pool cleaner comprising:

a. a driven wheel or pulley;

b. a first gear connected to the driven wheel or pulley;

c. a second gear;

d. a third gear;

e. a shaft (i) connecting the first gear to the driven wheel or pulley and (ii) defining a shaft axis;

f. means, comprising a boss connected to the shaft, for moving the first gear in an arcuate path so as to engage either of the second and third gears, engagement with the second gear causing rotation of the driven wheel or pulley in a first direction and engagement with the third gear causing rotation of the driven wheel or pulley in a direction opposite the first direction, the boss being configured to pivot about an axis offset from the shaft axis.

13. An automatic swimming pool cleaner comprising:

a. a fluid-powered motor;

b. first and second driven wheels or pulleys;

c. a first drive assembly connected to the fluid-powered motor and the first driven wheel or pulley and configured to rotate in each of a first direction and a second direction opposite the first direction;

d. a second drive assembly connected to the fluid-powered motor and the second driven wheel or pulley and configured to rotate in each of the first and second directions; and in which, during operation, rotation direction of the second drive assembly is at least partially independent of rotation direction of the first drive assembly.

14. An automatic swimming pool cleaner according to claim 13 in which, during operation, rotation direction of the second drive assembly as a function of time may differ from rotation direction of the first drive assembly as a function of time.

* * * * *